United States Patent [19]

Mettenbrink

[11] Patent Number: 4,775,080

[45] Date of Patent: Oct. 4, 1988

[54] DISPENSER FOR PASTE MATERIAL

[75] Inventor: Herbert Mettenbrink, Lohne/Oldenburg, Fed. Rep. of Germany

[73] Assignee: Bramlage Gesellschaft mit beschrankter Haftung, Lohne/Oldenburg, Fed. Rep. of Germany

[21] Appl. No.: 945,083

[22] Filed: Dec. 22, 1986

[30] Foreign Application Priority Data

Dec. 21, 1985 [DE] Fed. Rep. of Germany ..... 3545743

[51] Int. Cl.[4] ..... B67D 5/42

[52] U.S. Cl. ..... 222/391; 222/153; 222/405

[58] Field of Search ..... 222/207, 209, 213, 214, 222/210, 256, 257, 259, 260, 324, 391, 405, 509, 386, 153

[56] References Cited

U.S. PATENT DOCUMENTS 3,255,935 6/1966 Spatz ..... 222/391
4,413,759 11/1983 Mettenbrink ..... 222/260
4,421,255 12/1983 Czech ..... 222/391
4,511,068 4/1985 Bossina ..... 222/257
4,598,843 7/1986 Foster et al. ..... 222/260

*Primary Examiner*—H. Grant Skaggs
*Attorney, Agent, or Firm*—Collard, Roe & Galgano

[57] ABSTRACT

There is provided a dispenser for paste material, such as tooth paste, having a movable piston disposed in the dispenser casing below the paste material adapted to move in the direction of the nozzle opening and prevented from moving in the opposite direction by a first locking mechanism, and a push button for the displacement of an upper pressure cover which is disposed inside the dispenser casing above the material and which is coupled with the piston through a rod which penetrates and is force locked with the piston by means of a second locking mechanism working opposite to the first locking mechanism. A guide piece is provided which is connected with the rod and the pressure cover and extends above the pressure cover, passing through a guide opening in the casing top surmounting the pressure cover. The guide piece is connected to the push button mounted in the casing top.

15 Claims, 7 Drawing Sheets

DISPENSER FOR PASTE MATERIAL

The present invention relates to a valveless dispenser for paste materials, such as tooth paste, having a movable piston disposed inside the dispenser casing below the paste material which travels during discharge of the dispenser in the direction of the nozzle opening and which is prevented from moving in the opposite direction by a locking mechanism. The dispenser furthermore has a push button with an operating surface for displacing a pressure cover disposed inside the dispenser casing above the paste material which is coupled with the piston through a pump rod that penetrates the piston and is power locked with the piston through the intermediary of a second locking mechanism acting in the opposite direction to the first locking mechanism.

A dispenser of this type is disclosed in German Patent document No. DE-OS 30 45 048. According to the disclosure in this patent document, the end of the pump rod at the discharge end of the dispenser engages a compressible bellows like header. The movement of this header can deviate from the principal axial direction of the dispenser and be transmitted to the discharge end of the pump rod. Therefore, the discharge end of the pump rod, especially in the initial stage of discharge, is not properly supported radially. Any tilting or leaning movements of the rod are transmitted to the piston at the lower end of the dispenser and can impair the operation of the locking devices therefor.

The object of the present invention is to improve the operating dependability of a valveless type paste dispenser as described above by means of simple technological instrumentalities.

The above object is accomplished in accordance with the present invention and results in the type of dispenser described above having greater serviceability. The pump rod of the dispenser is guided linearly between the piston and the casing top in such a way that within the operability of the dispenser, no more tiltings occur which can impair the operational reliability of the locking mechanism. Even with such an advancement, there is no need to dispense with the bellows like pressure cover and the structural means utilized are simple and do not result in increased costs. The invention provides in an axial continuation to the pump rod a guide piece which connects with the rod, connects with and extends beyond the pressure cover, and passes through a guide opening in a casing top surmounting the pressure cover. Above the casing top the guide piece is connected with a push button that embodies a push button operating surface, and is mounted in the casing top. The casing top surmounting the pressure cover considerably improves the diffusion tightness since the flexible materials normally used do not possess good locking characteristics. The casing top also provides a protected location for the pressure cover inside the casing and imparts a stabilization to this section of the casing that is subjected to higher mechanical stresses during operation. Any nonaxial working forces are absorbed within the guide opening.

A favorable configuration of the linear guidance for the push button consists of a cup shaped recess formed in the casing top and the push button's connection by means of a pin with the piston shaped pressure cover, the cylinder of which is formed by a collar, protruding from the casing top and spatially separated from the inner wall of the casing. This results in a friction free guidance of the piston which is therefore easily movable. The linear guidance of the piston contributes to the guidance, whereby the collar forming the cylinder provides a substantial additional stabilizing moment, so that a surprisingly small wall thickness can be used. The connection of the components forming the discharge mechanism is accomplished in a simple manner by a locking device between the push button and a connecting pin which protrudes from the cup shaped recess of the casing top.

There is also provided a good configuration for the push button operating surface by pivotally mounting the push button around a pivot edge in the casing top and through a ball and socket joint coupling it with a central pin of the piston shaped pressure cover, the cylinder of which is formed by a collar protruding from the casing top which also is spatially separated from the inner wall of the casing. The above measures permit a very simple assembly that can be accomplished by automatic machinery. It is further advantageous that the pin is guided in a socket of the casing which is directed inward into the casing. Such a guidance can conveniently include free play, resulting in the favorable withdrawal of the ribbon of dispensed paste remaining outside the nozzle, as described in the above mentioned patent. Thus, with the elimination of the free outside hanging ribbon of paste material, the smudging or plug like drying of the remaining material does not occur.

According to the present invention, it is further proposed that a pivotable push button be mounted in a space formed above the casing top by an upper wall, side walls and the nozzle duct, where the spring formed integrally with the push button is also located. Positioning the button in such an enclosure avoids an exposed location so that accidental touching of the button leading to unintentional discharge does not occur. Rather, an intentional, targeted displacement of the push button is required by applying pressure to a defined place. It is further advantageous if the central portion of the pressure cover is continued into the tubular guide piece, the bore of which leads to the nozzle discharge duct. Thus, by being included in the duct configuration the guide piece takes on an additional task. It can be readily made integral with the refinement that the expanded end connection section of the rod forms the passage cross sections to the bore of the guide piece. Such passage cross sections are located in the very region of the pressure cover so that a complete discharge is possible.

Furthermore according to the invention, the push button may be formed as a one arm lever acting on the center section of the guide piece. Thus, the operating forces are favorably transmitted so that the whole cross section of the dispenser casing, i.e. its top part, is available for mounting the lever. A suitable connection of the parts forming the discharge mechanism is accomplished in a simple manner by a snap fastener type joint between the end of the tubular guide piece located above the casing top and a cage forming the expanded end connection section of the rod and also between a nozzle which protrudes, directed downward, from the flexible pressure cover. Such a cage centrally located has the advantage of a uniform passage of the substance into the nozzle duct. Moreover, the annulus around the protruding nozzle can be used for housing a second substance, which will deposit as a stripe on the discharge strand. Such a deposit can be obtained simply by providing at least one additional opening in the attachment region of the nozzle to the pressure cover and below the pressure cover. The corresponding additional component is deposited on the strand that is already extensively formed in the nozzle.

Furthermore according to the invention, the pressure cover may be formed with circumferential accordion type folds. Such a membrane type member possesses high internal flexibility. The restoring force derived therefrom functions as a return spring and lasts to give long service life. Such a member also excludes the danger of a self locking slipping over. Another suitable connection between the pump rod and the pressure cover is effected by shaping the expanded end connection section of the rod into a web, the ends of which are locked into recesses at the inner wall of the bore of the guide piece. Such a configuration can also be utilized to form the free play mentioned. The installation of the pressure cover can be accomplished by uncomplicated means by simply snapping or clamping it circumferentially into an annular groove. The inherent flexibility of the material utilized supports the corresponding arrangement types.

Finally, yet another favorable configuration exists, namely, a foil which tightly seals the piston area and which extends free-stretched within the length of the operating stroke of the lower pointed end of the rod. Such a measure guarantees long lasting freshness and, if perforated, it can be determined that the dispenser has already been opened or operated. Thus, a tamperproof package can be obtained by simple means. Otherwise the perforation can serve for pressure equalization.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
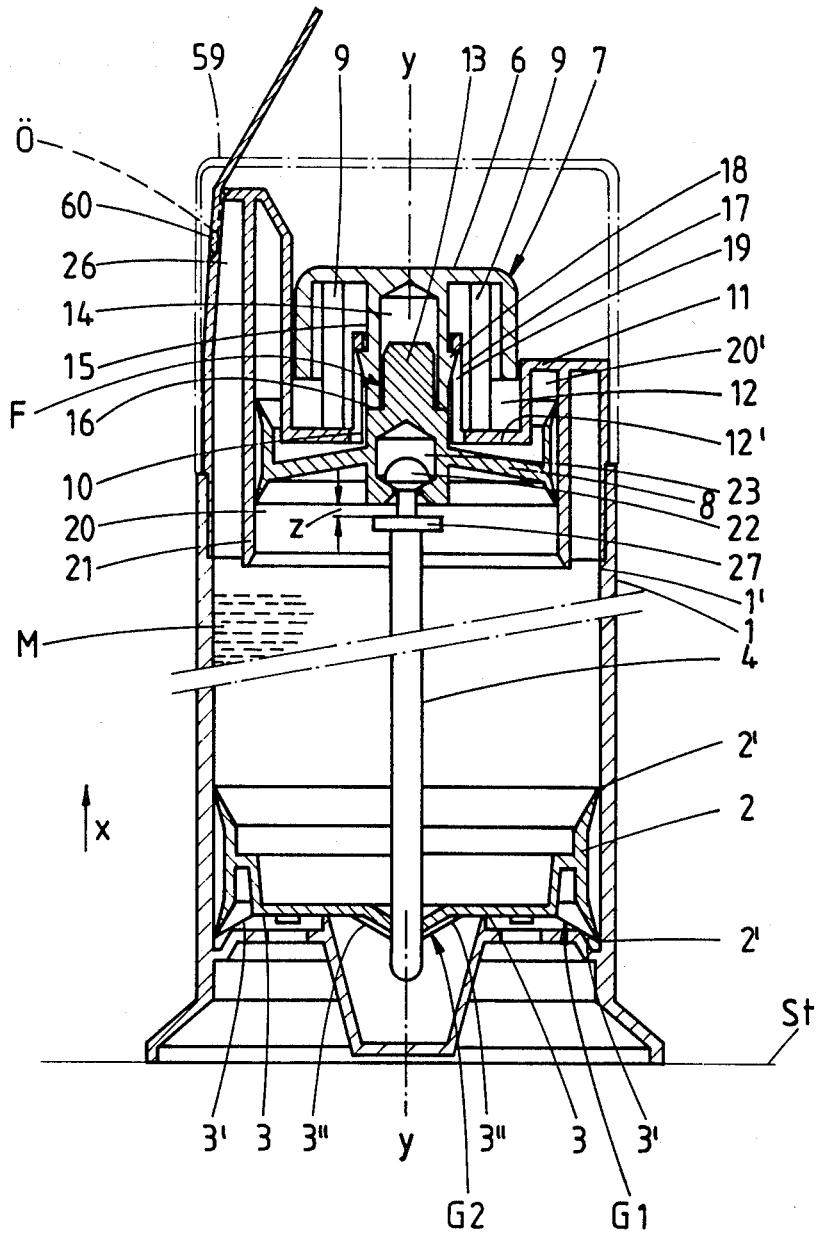
FIG. 1 is a vertical cross-sectional view of a first embodiment of the dispenser according to the present invention, with a casing top formed separately as an additional part.

Now turning to the drawings, there is shown in FIG. 1 a long cylindrically shaped casing 1 of a dispenser which contains the paste material M, such as tooth paste. For discharge there is a piston 2 arranged below the material M, which, during discharge of the dispenser, gradually moves in the direction of the arrow x. Its skirt lip 2' runs tightly along the inner wall 1' of casing 1. With the exception of the embodiment according to FIG. 1, the casing is open on the underside so that the dispenser can be filled from this end with the top part pointing downward.

The unidirectional movement of piston 2 is achieved by a first locking mechanism G 1. This is a so-called clamping module 3 in the form of a star with radial serrations 3' formed of spring steel. Laid out flat, the circumference of the serrated edge is somewhat larger than the inside diameter of casing 1, so that the teeth of the serration interlock as inclined support legs with inner wall 1' of the casing in a direction opposite to the direction of arrow x.

Figure 6:
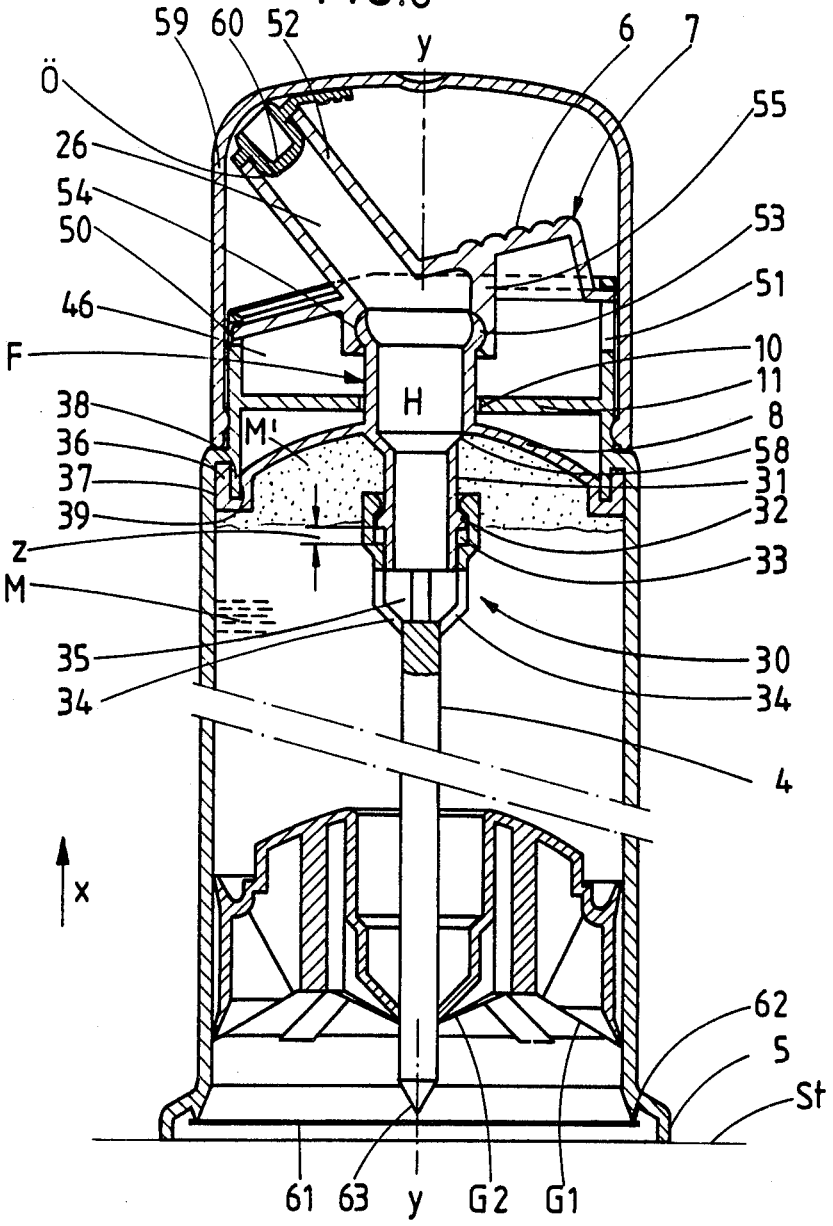
FIG. 6 is a vertical cross-sectional view of a third embodiment of the dispenser according to the present invention.

In the center, clamping module 3 forms a second locking mechanism G 2. The latter acts in conjunction with a pump rod 4 passing centrally through piston 2. The correspondingly inwardly directed teeth of serration 3'' engage rod 4 which is in the form of a smooth round bar. Projected into a plan view, the opening left by the teeth of the serration of the clamping module is smaller than the diameter of rod 4. The end of rod 4 which faces the mounting surface ST of the vertically standing dispenser, is rounded or, as shown in FIG. 6 (third embodiment), pointed. The teeth of serrations 3'' form inclined support legs that permit an unimpeded insertion of rod 4 opposite to the direction of arrow x. On the other hand a movement of the rod in the direction of arrow x engages piston 2 due to a force locking coupling.

On the side opposite to the somewhat widened base 5, that is at the top, dispenser casing 1 includes a push button operating surface 6, which effects the upward movement of piston 2. The complete push button is designated by the reference numeral 7. Passing through a maximum stroke, limited by a stop, push button 7 displaces pressure cover 8, arranged above material M in the dispenser casing, in a direction opposite the direction of the arrow x. By this downward displacement, pump rod 4, connected with pressure cover 8, is moved downwardly in the direction of its axial extension coinciding with the longitudinal central axis y-y of the dispenser. The return to the starting position is accomplished by a biasing force, be it, that the casing top itself possesses the corresponding restoring force or that, as for instance, in the preferred embodiment shown in FIGS. 1 to 3, special springs 9 are provided.

Rod 4 according to all embodiments extends axially into a guide piece F above pressure cover 8. Guide piece F passes through a guide opening 10 in casing top 11 which surmounts pressure cover 8. Using suitable clamping devices the connection of push button 7 with pressure cover 8 is accomplished above casing top 11. In view of the now also indirect guidance for rod 4 at the dispenser head, the rod moves only linearly and thus without tilting.

Figure 2:
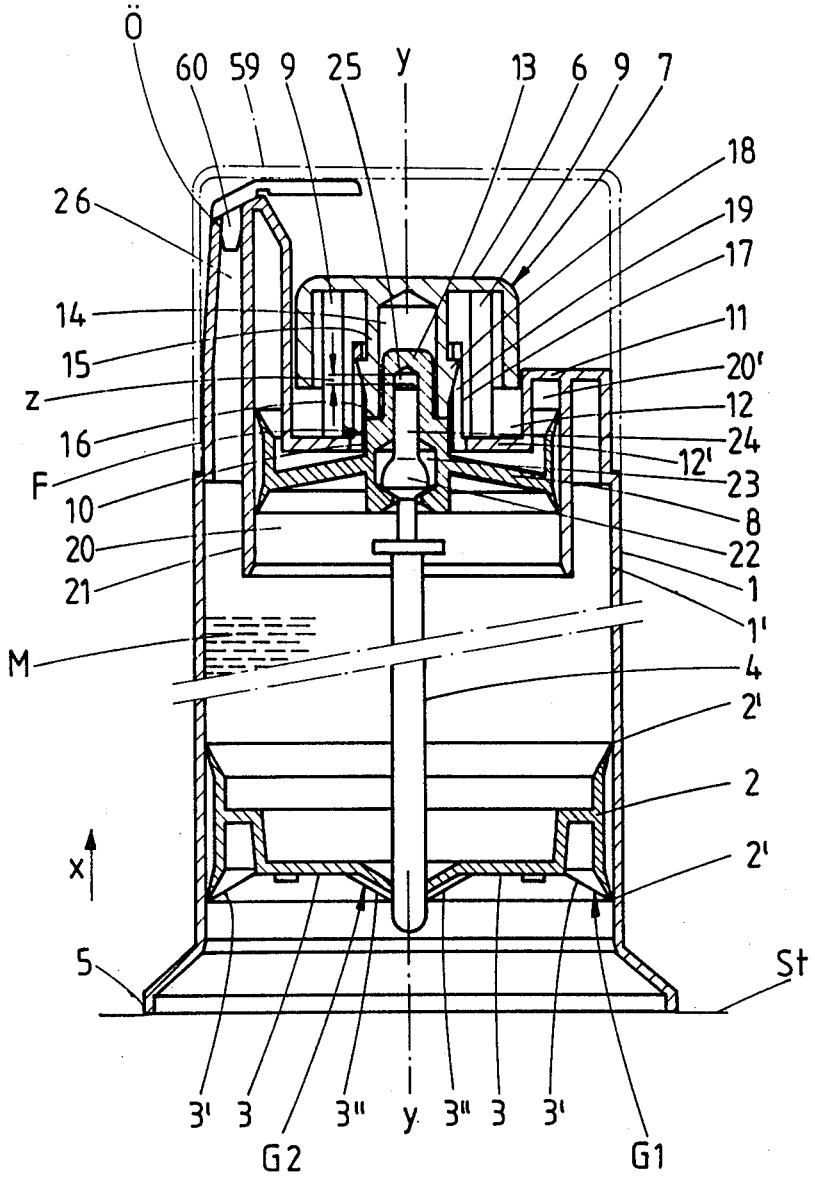
FIG. 2 is a view similar to FIG. 1 of a slightly modified dispenser with the casing top as integral part of the casing.
Figure 3:
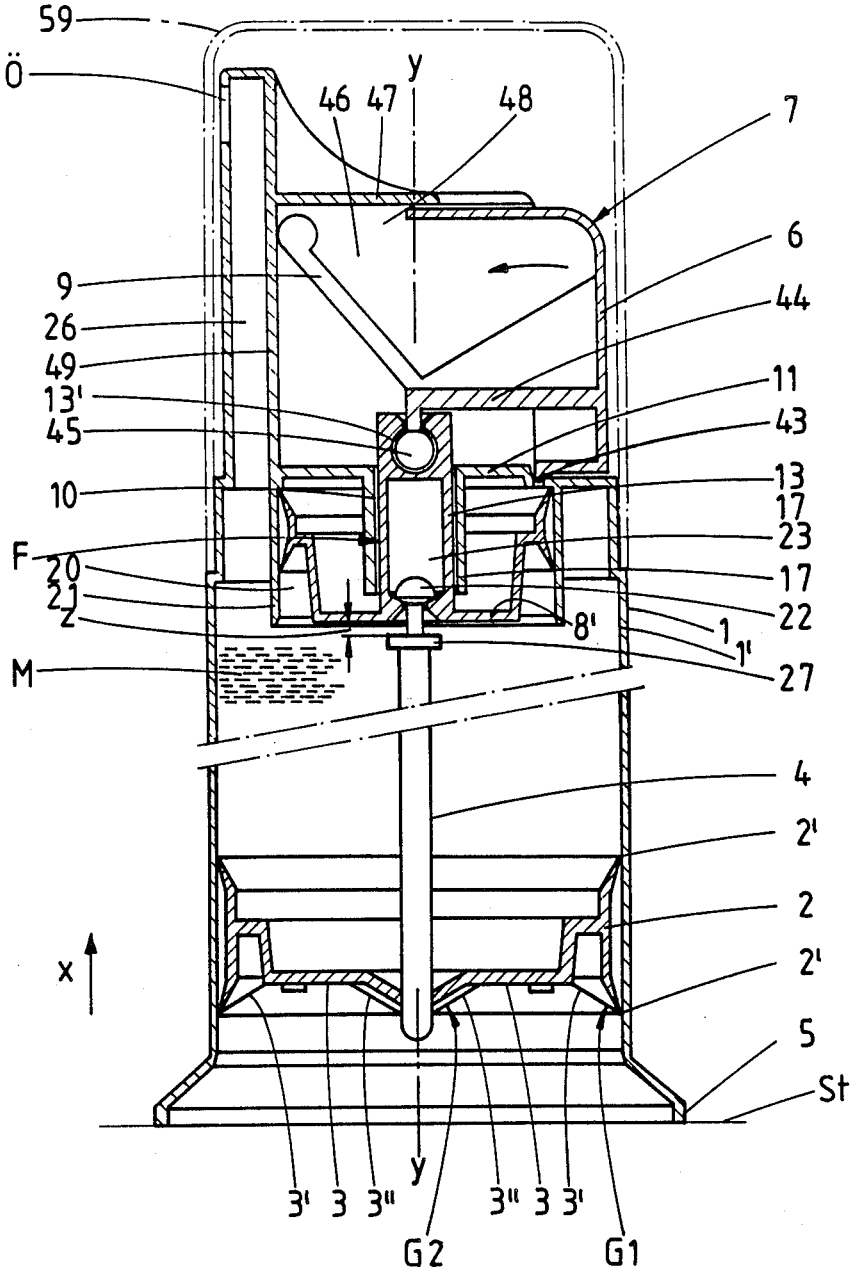
FIG. 3 is a vertical cross-sectional view of a second embodiment of the dispenser according to the present invention.
Figure 4:
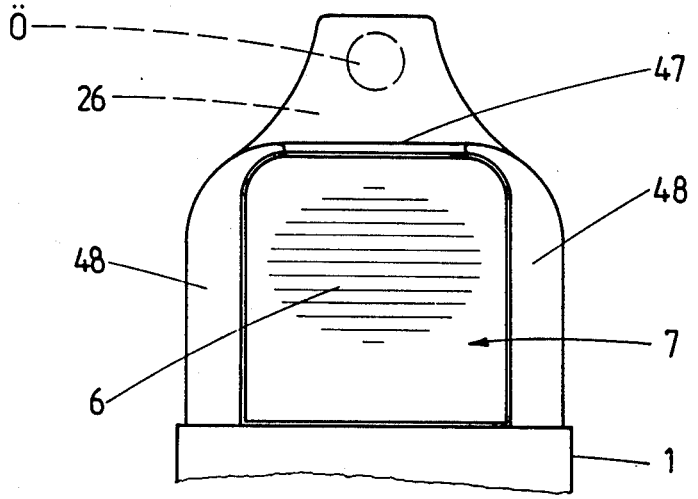
FIG. 4 is an elevational view of a portion of the dispenser showing the push button area.

In the embodiment according to FIGS. 1 and 2, cap shaped push button 7 is guided in a cup shaped recess 12 formed in casing top 11, more accurately along the wall of the recess which is located in the axial direction. From the inner surface of the cover of cap shaped push button 7 protrude integrally formed bar springs 9, which are supported at the bottom 12' of recess 12. Two springs are provided, suitably positioned diametrically opposite each other.

Bottom 12' of recess 12 acts as limit stop for push button 7 when its cap edge touches down on the bottom. Push button 7 and pressure cover 8, shaped according to FIGS. 1 to 3 like a piston, are rigidly connected with one another through a pin 13 which may be a locking joint but can also be a press fit connection. Pin 13 enters with a chamfered section into bore 14 of a socket centrally protruding from the inner surface of push button 7 (see FIGS. 1 and 2). The plug-in joint is defined by a ring shoulder 16 provided on guide piece F which engages against the free forward edge of socket 15.

Push button 7 and pressure cover 8 are further connected by a locking device with a socket 17 which forms the guide opening and which centrally protrudes from bottom 12' of recess 12, and extends in the direction of push button 7. Socket 17 is integrally formed with casing top 11.

Locking is achieved by splines 18 which are positioned diametrically opposite each other and are guided axially in elongated slots 19 of socket 17. The steeper flanges of splines 18 strike against the upper lateral edge of elongated slot 19. The length of elongated slots 19 matches the working stroke. The back of splines 18 are shaped as mounting bevels. This assists in completing the plug-socket connection. Piston shaped pressure cover 8 runs in a cylinder space 20 formed by a collar 21 which is integrally formed to be free standing on the underside of casing top 11. The inner circumferential edge of the collar is chamfered to ease the insertion of the piston body, which, as far as the shape of the skirt lips is concerned, in its design corresponds to that of piston 2. Recess 12 is formed by an indentation and protrudes into the top of the piston space. Collar 21 and the recess wall possess the corresponding radial clearance resulting in a ring groove 20'. Collar 21 leaves a radial clearance to inner wall 1' of casing 1 and surrounds it concentrically.

The connection between rod 4 and socket 13 of pressure cover 8 is accomplished through a mushroom head 22 on the end of rod 4, which is snapped into hollow 23 of pressure cover 8 turned toward material M.

As can be clearly seen in the modification of FIG. 2, the mushroom head extends further into a pin 24 pointing in the direction of push button 7. The pin ends at a distance before the bottom of a blind bore 25 of the socket 13 matching the cross section and provided with adequate lateral clearance. The distance provides a free play z between pressure cover 8 and rod 4. The effect is that after the completed discharge operation no leftover of the paste material remains outside nozzle opening Ö of discharge duct 26. On the contrary the rest of the paste material is withdrawn again into nozzle opening Ö. The corresponding free play z results in a shorter stroke of piston 2, pushing paste material M, compared with the relatively greater stroke of pressure cover 8, with the result that when the push button is released the desired suction effect is generated. The length of hollow 23 is equated to the necessary play.

In the embodiment according to FIG. 1, the stop providing the free play is achieved between a collar 27 located below the locking position and the section of guide piece F forming stop groove 23. The same configuration is also used in the second embodiment of FIG. 3. The identical reference numerals are accordingly used.

Figure 7:
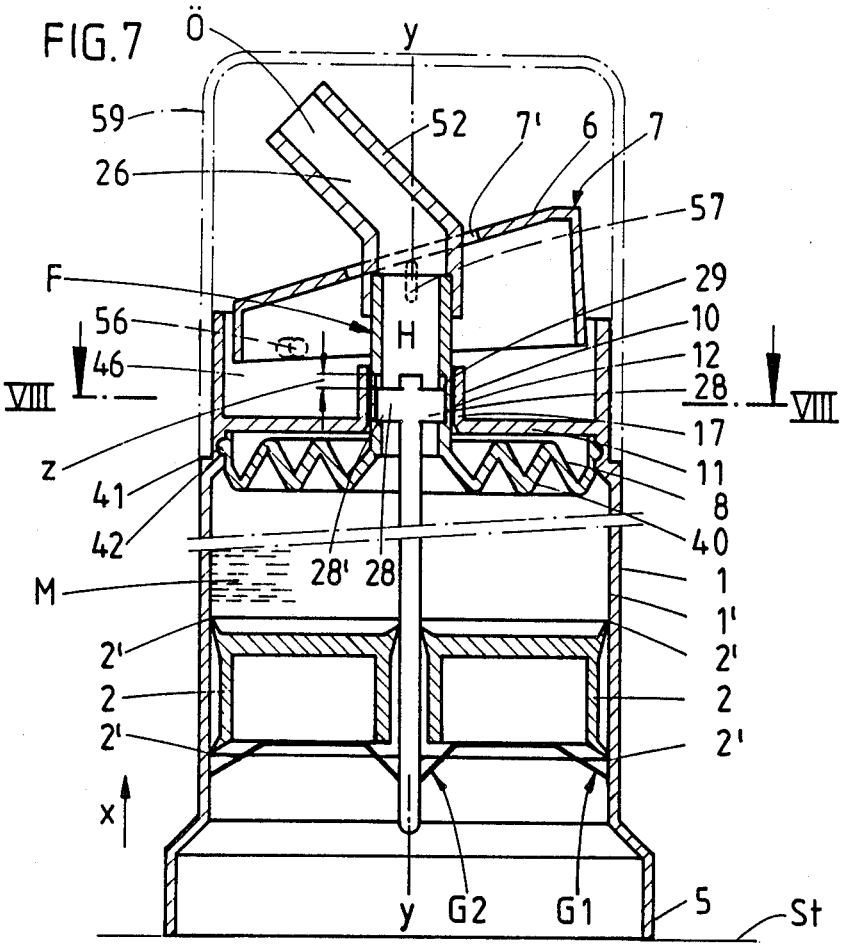
FIG. 7 is a vertical cross-sectional view of a fourth embodiment of the dispenser according to the present invention showing the pressure cover formed with circumferential accordion folds.
Figure 8:
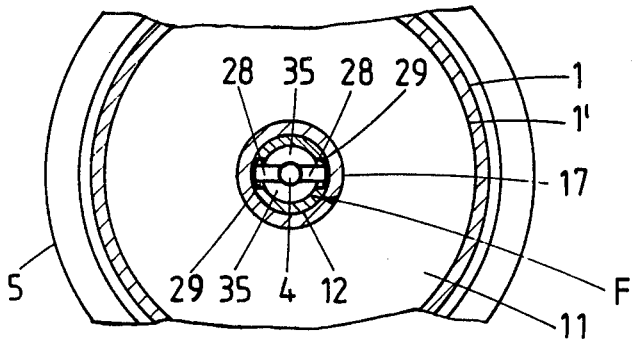
FIG. 8 is a cross-sectional view of the dispenser of FIG. 7 taken along line VIII—VIII of FIG. 7.
Figure 9:
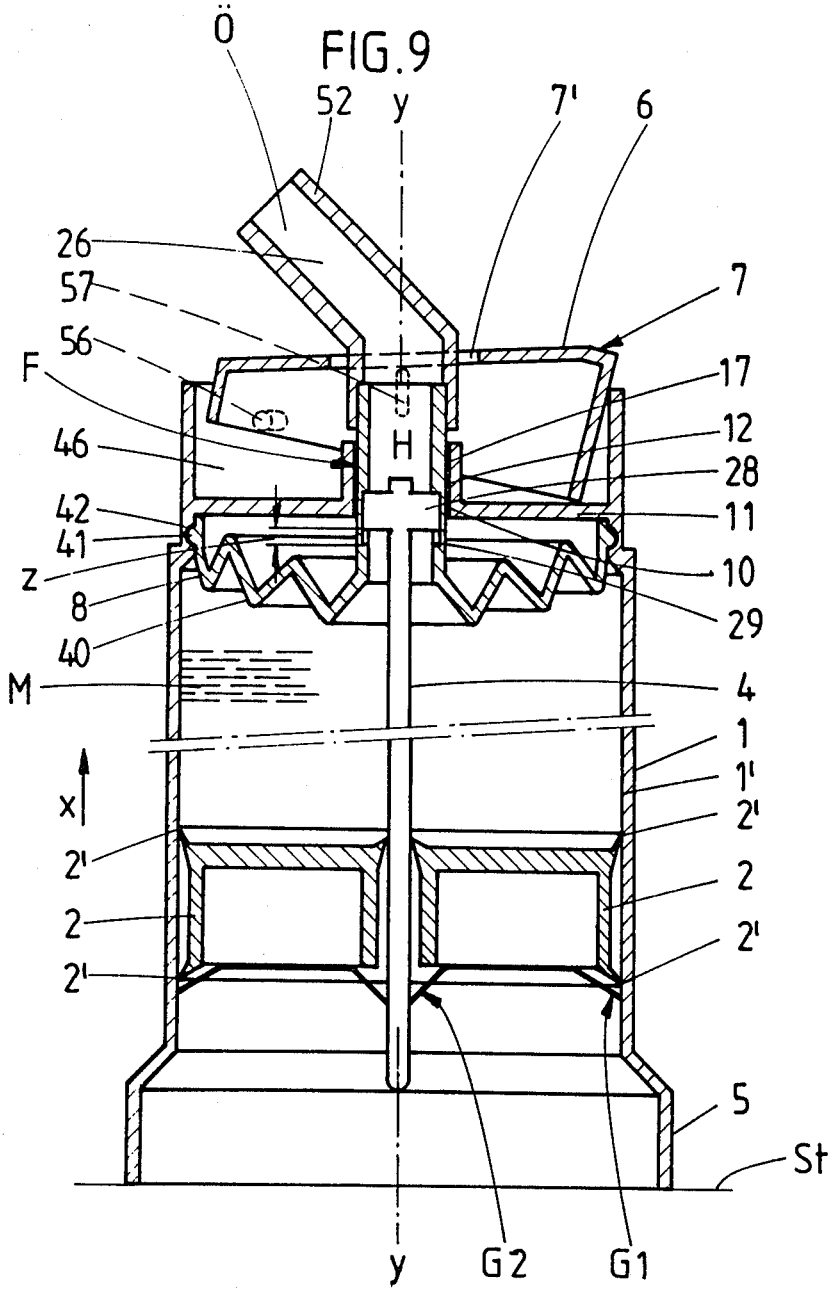
FIG. 9 is a cross-sectional view of the embodiment according to FIG. 7, during operation of the discharge mechanism.

In the fourth embodiment of FIGS. 7 to 9, the approach taken is that the expanded section of the end connection of rod 4 is shaped as a spline section. The splines 28 are located diametrically opposite each other and engage with their spline ends the recesses 29 at the inner wall of bore H of guide piece F. Recesses 29 are in the form of elongated slots. Splines 28 are locked in the recesses. The free play z is provided by a correspondingly greater axial length of recesses 29 in relation to the height of splines 28.

According to the embodiment of FIG. 6, the end connection between rod 4 and guide piece F is accomplished by a snap connection. For this purpose the end of rod 4 facing pressure cover 8 comprises a cage 30, into which projects nipple-like connecting piece 31 protruding from the underside of the pressure cover. Connecting piece 31 forms on its surface a stop ring of individual protuberances. The latter engage in a ring groove 33 attached to the rim of the cage. The axial height of the ring groove here again matches the above described free play z. The actual, perforated section of the cage starts only below ring groove 33. This section of the cage is formed by axially directed bars 34 which connect the end connection section with rod 4. Between bars 34, which are bent inward at half length and are seated in the top section of rod 4, cross sections 35 are open for material flow. The material M passes through these cross sections, then proceeds through connecting piece 31 and through bore H of guide piece F, and advances into discharge duct 26.

In the embodiment according to FIGS. 7 to 9, the paste material passes pressure cover 8 at the end connection section between rod 4 and the bore H of guide piece F which runs in a socket 17 formed integrally at the topside of casing cover 11. As can be seen in FIG. 8, all splines 28 are kept rather flat so that passage cross sections 35 are left in the form of segmented cross sections on both sides of the splines. The snap-in connections between the spline section and tubular guide piece F are located essentially within the zone surrounded by socket 17, which provides radial support for the section of guide piece F containing recesses 29. To ease the snap connection between the spline and the mentioned guide piece F, the tubular section perpendicular to the plane of the slot shaped recesses 29 can be flattened slightly. Otherwise the upper edge of splines 28 lying in the direction of the plug-in connection must be chamfered so that a mounting bevel is obtained for easier plug in of rod 4.

According to the embodiment of FIG. 6, pressure cover 8 consists of an elastically deformable dome shaped section which at its edge is attached to casing 1 by a clamping connection. For this purpose the edge of the pressure cover forms a ring bar 36 which engages a matching groove 37 in casing 1. The groove is formed by a ring wall 38 set in toward the inner wall of the casing, which engages a groove 39 at the edge of pressure cover 8. The oppositely oriented groove engagement leads to a tight clamp fit.

Socket 31 and tubular guide piece F are oppositely oriented and integrally formed in the zenith of pressure cover 8.

In the embodiment according to FIGS. 7 to 9, pressure cover 8 has an accordion type ring 40. The zig zag folds running concentrically around guide piece F have an acute angle sharp notch form. The folding angle amounts to about 40°. The fold next to rod 4 forms a plug-in cone and goes over into guide piece F. The peripheral fold on the other hand forms a circumferential clip protuberance 41 which interlocks into a matching ring groove 42 of casing 1. Ring groove 42 is located somewhat below casing top 11. After release of push button 7 the two described flexible pressure covers 8 return again into the start position due to their inherent restoring force.

While, according to the first embodiment of FIGS. 1 and 2, the push button operating surface is formed by a linearly displaceable push button 7, the other embodiments use hinged push buttons. Thus, in the case of the second embodiment of FIG. 3 a rocker lever is employed which acts on the center part of guide piece F. The lever pivots about a tilting edge formed by a recess of casing top 11 into which tooth shaped protuberances of the button engage. Pivot edge 43 is located diametrically opposite discharge duct 26 located off-center. Push button operating surface 6 is vertical and from the lower, first third of its height a radially inwardly directed horizontal arm 44 protrudes the end part of which, directed downward in the longitudinal center plane y-y, is coupled by a ball and socket joint, designated 45 and 13' respectively, with center socket 13 of piston shaped pressure cover 8. Recess or socket 13' accommodating ball 45 is expanded at its entrance in the form of a cone to provide the necessary free play. From the free end of arm 44 protrudes a spring 9 with an inclined rise to the left. It is executed as a leaf spring and rests against the wall of vertical discharge duct 26, the discharge opening Ö of which is directed outwardly.

Figure 5:
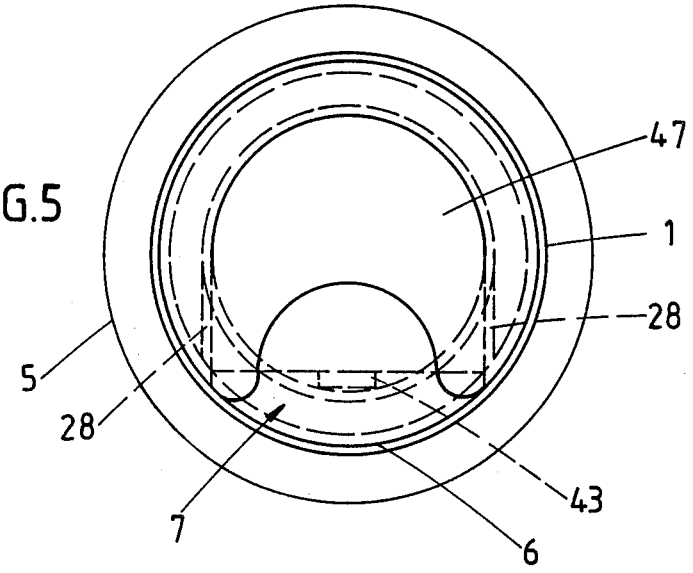
FIG. 5 is a plan view of the dispenser shown in FIG. 4.

In this embodiment socket 17 is directed inwardly into casing 1 and immerses into the interior of the piston-like pressure cover 8 which creates the corresponding immersion depth for socket 17 by pushing down on its center wall 8'. Tiltable push button 7 is mounted in space 46 above casing top 11 and is enclosed by a horizontal upper wall 47, two side walls 48, and wall section 49 which also forms the discharge duct. Nozzle discharge duct 26 extends above upper wall 47. The area of push button 7 accessible for operation may still be increased by cutting back upper wall 47 recess-like, as clearly seen in FIG. 5.

In the third and fourth embodiments, push button 7 is formed as a one arm lever that acts on the center part of guide piece F. In the embodiment according to FIG. 6, the tilting position is formed by a plug-in recess 50 in the casing wall, which a tooth shaped protuberance of the push button engages. The other end runs in a recess 51 in space 46 shaped like a window and which limits the tilting movement. Discharge duct 26 is formed as an integral part of push button 7, namely, by integrating a corresponding tubing 52. Movable guide piece F protruding through the guide opening 10 of casing top 11 is connected with push button 7 by a snap fastener like joint. For this it forms at its top section a bulging male protuberance 53 which engages a female opening 54 of a tubular socket arranged at the underside of the push button. The flexibility of guide piece F formed integrally with deformable pressure cover 8 compensates tilting movements in the area of the push button.

In the fourth embodiment of FIGS. 7 to 9 there is again a separate push button 7, hinge-mounted at 56 and with a sufficiently large center opening 7' for passage of angular tubing 52 that is plugged into guide piece F formed integrally with the pressure cover. From the wall of the tubing arranged perpendicularly to the tilting plane protrude follower bosses 57 which grip under the edge of the through opening 7' and thus transfer the shifting movement of push button 7 to guide piece F. The head rim of the cap shaped body of the button strikes the top side of the casing wall 11 at the side opposite to support 56 and thus forms the limit stop for this movement.

In the third embodiment of FIG. 6, at least one additional opening 58 has been provided in the attachment area of socket 31 and pressure cover 8. This opening permits the passage of a second component M' stored above the paste material M having, if necessary, a different staining characteristic.

The region of the nozzle opening of all dispensers may be covered by a cap 59. The nozzle opening Ö is closed by a plug 60 so that drying of the material is effectively prevented. There is also a provision for sealing the piston area of the casing by a sealing foil 61. This free-stretched foil is attached to a circumferential rib 62 of casing 1 outside the guide section for the piston. The foil is stretched directly in front of the pointed end of rod 4 to prevent on the one hand a vacuum and on the other hand to visually show that the dispenser has been used. When operating push button 7, point 63 penetrates the foil.

The manner of operation, briefly described, is as follows:

The operation of push button 7 effects a displacement of pressure cover 8 which reduces the volume in casing 1. An amount of paste material is displaced and dispensed through discharge duct 26 which corresponds to the displacement of pressure cover 8. After passing through the free play z, the downward movemnt of pressure cover 8 is transmitted to rod 4. The resetting occurring after the release of push button 7 causes an upward movement of piston 2 by an amount equal to the discharged volume. Because the upward movement of the piston occurs after a small time delay, and the vacuum created in the dispenser top generates a suction force, the ribbon of paste protruding beyond the nozzle opening Ö, is always immediately withdrawn, that is before the piston movement. There remains, therefore, no remainder subjected to drying out by the surrounding outside air. Accordingly no hardened plug of paste is formed. On the contrary the part withdrawn into the lower section of discharge duct 26 immediately comes in contact with the moist supply. The movement of the rod occurring during the discharge operation proceeds, due to guide piece F, without tilting. Therefore no adverse configurations of the clamping module occur. The upward movement of piston 2 is always completed before the vacuum is equalized across nozzle opening 26, the paste material itself acting as a barrier.

According to the embodiment of FIG. 1, the inserting of piston 2 is accomplished from the top with the aid of a jacket. In all other cases it is done from below without the aid of an auxiliary tool. The jacket keeps the teeth 3' away from the inner wall of the casing. Only after the withdrawal of the jacket are the teeth able to engage the casing wall for a hook-on.

While several embodiments of the present invention have been shown and described, it will be obvious that many changes and modifications may be made thereunto without departing from the spirit and scope of the invention.

What is claimed is:

1. In a dispenser for paste material, such as tooth paste, said dispenser including a dispenser casing containing the paste material, a casing top having a guide opening therein, a nozzle opening in communication with said paste material, a movable piston arranged in the casing below the paste material, said piston being adapted to move at discharge of the dispenser in the direction of the nozzle opening and being prevented from moving in the opposite direction by a first locking mechanism, an upper presure cover disposed in the dispenser casing above and in contact with the paste material and displaceable by a push button having an operating surface, and a rod coupling said upper pressure cover with said piston, said rod penetrating and being forced locked with said piston by a second locking mechanism acting in the opposite direction from the first locking mechanism, the improvement comprising:

a guide piece operatively connected to said rod and said upper pressure cover and extending above said upper pressure cover, said guide piece extending through the guide opening in the casing top and being operatively connected with the push button having the operating surface, said push button being mounted in the casing top.

2. The dispenser according to claim 1, wherein said push button is guided in a cup shaped recess formed in the casing top and is connected through a socket with the upper pressure cover, said pressure cover being formed in the shape of a piston with the cylinder therefor being formed by a collar protruding from the casing top which is spaced from the inner wall of the dispenser casing.

3. The dispenser according to claim 2, which further comprises a locking joint formed between the push button and a socket in the casing top, said socket extending from the bottom of the cup shaped recess.

4. The dispenser according to claim 1, wherein the push button is pivotally mounted about a pivot edge and is coupled through a ball and socket connection with a central socket in the pressure cover said pressure cover being formed in the shape of a piston with the cylinder therefor being formed by a collar protruding from the casing top and spaced from the inner wall of the casing.

5. The dispenser according to claim 4, wherein the pressure cover central socket is guided in a socket in the casing top which is directed inwardly into the dispenser casing.

6. The dispenser according to claim 4, wherein the push button is pivotally mounted above the casing top in a space formed by an upper wall, side walls, and a discharge duct for the nozzle opening, and which further includes spring biasing means for biasing the push button disposed in said space.

7. The dispenser according to claim 1, wherein the upper pressure cover is continued in its center part into said guide piece to which it is connected and which is tubular in shape, the bore of said tubular shaped guide piece leading to a discharge duct for said nozzle opening.

8. The dispenser according to claim 7, wherein said rod has an expanded end connection part for connection to said guide piece, said expanded end connecton part having a passage therethrough to the bore of said guide piece.

9. The dispenser according to claim 8, wherein said guide piece includes a connecting piece extending downwardly from said upper pressure cover, said upper pressure cover being flexible, and further comprising snap fastener connections between said guide piece and the push button and between the connecting piece of said guide piece and a cage forming the expanded end connection part of the rod.

10. The dispenser according to claim 9, wherein at least one additional opening is provided in said connecting piece of said guide piece which is formed in the connection area with said pressure cover and communicates with the interior of said dispenser casing.

11. The dispenser according to claim 8, wherein the expanded end connection part of the rod is in the form of a spline section having splines which fit into recesses in the inner wall of the bore of said guide piece.

12. The dispenser according to claim 1, wherein said push button is formed as a one arm lever, acting upon the center part of said guide piece.

13. The dispenser according to claim 1, wherein the pressure cover is in the form of an accordion type ring folding.

14. The dispenser according to claim 1, wherein the pressure cover is clipped peripherally into a ring groove formed in the dispenser casing.

15. The dispenser according to claim 1, wherein said rod has a defined operating stroke and the part of said dispenser casing below said piston is sealed by a sealing foil which extends within the length of the operating stroke of the rod, said rod having a pointed lower end.

* * * * *